United States Patent [19]

Pejouhy

[11] 4,287,499

[45] Sep. 1, 1981

[54] CURRENT INTERRUPTING APPARATUS HAVING IMPROVED CONTACT LIFE

[75] Inventor: Radi Pejouhy, Marshfield, Mass.

[73] Assignee: Texas Instruments Incorporated, Dallas, Tex.

[21] Appl. No.: 974,454

[22] Filed: Dec. 29, 1978

[51] Int. Cl.[3] ..... H01H 61/00

[52] U.S. Cl. ..... 337/97; 29/622; 200/144 B; 313/226; 335/151

[58] Field of Search ..... 29/622; 337/97; 200/149 R, 149 A, 144 B; 313/223, 185, 226, 224; 335/151

[56] References Cited

U.S. PATENT DOCUMENTS

| | | | |
|---|---|---|---|
| 2,365,518 | 12/1944 | Berkey | 313/223 |
| 3,621,568 | 11/1971 | D'Entremont | 29/622 |
| 4,114,127 | 9/1978 | Pejouhy | 337/97 |

*Primary Examiner*—Nicholas P. Godici
*Assistant Examiner*—Gene P. Crosby
*Attorney, Agent, or Firm*—John A. Haug; James P. McAndrews; Melvin Sharp

[57] ABSTRACT

A current interrupting device having improved contact life includes a hermetically sealed housing in which a thermostatic member is adapted to cause electrical contacts to move into and out of engagement depending on the temperature of the thermostatic member. The atmosphere within the housing is a gas having a dielectric strength slightly over the impressed voltage.

14 Claims, 2 Drawing Figures

CURRENT INTERRUPTING APPARATUS HAVING IMPROVED CONTACT LIFE

This invention relates to electric current interrupting devices and more particularly to such devices which are hermetically sealed.

Devices which incorporate thermostatic members, such as, for example, snap acting bimetallic elements, are conventionally used to interrupt circuits upon a thermal or current overload. In many cases the use of such devices is mandated by safety codes to protect various equipment, prevent overheating which could result in fire and other deleterious results. It is highly desirable that such devices have a long life since once a device fails the equipment it protects will either be subject to damage upon the occurrence of an overload or will be shut down until the device is replaced. To this end, various measures have been employed to enhance contact life and concomittantly device life. Backfilling of hermetically sealed thermostatic devices with various gases in one such way to improve contact life.

It has generally been the practice to use the highest dielectric gas available consistent with cost considerations and compatable with hermetic protector design. The most commonly used gas has been nitrogen since it has a high dielectric, is relatively inexpensive, readily available and very safe. However, even when backfilled gases are used in accordance with the teachings of the prior art contact life is not always satisfactory.

Improved contact life was obtained, particularly in thermostatic switches used with high current densities using a mixture of helium and argon at a pressure between approximately 0.75 and 2 atmospheres as set forth in U.S. Pat. No. 4,114,127 which issued Sept. 12, 1978. However, use of such noble gases is relatively expensive, particularly when compared to more readily available gases such as nitrogen or air.

It is therefore an object of the invention to provide an electric circuit interrupting device having improved contact life. Another object is the provision of a backfilling medium for a bimetallic snap acting hermetically sealed switch which is inexpensive, has desirable heat transfer and dielectric characteristics. Other objects will be in part apparent and in part pointed out hereinafter.

The invention accordingly comprises the elements and combination of elements, features and methods of construction and arrangement of parts which will be exemplified in the structures and methods hereinafter described, and the scope of the application of which will be indicated in the following claims.

Figure 1:
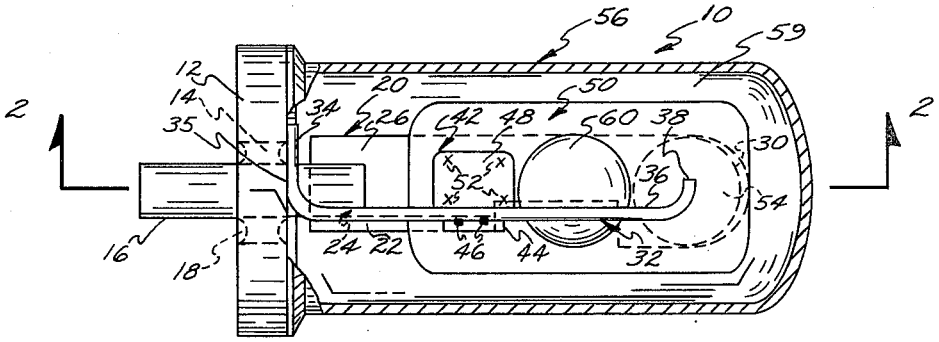
Figure 2:
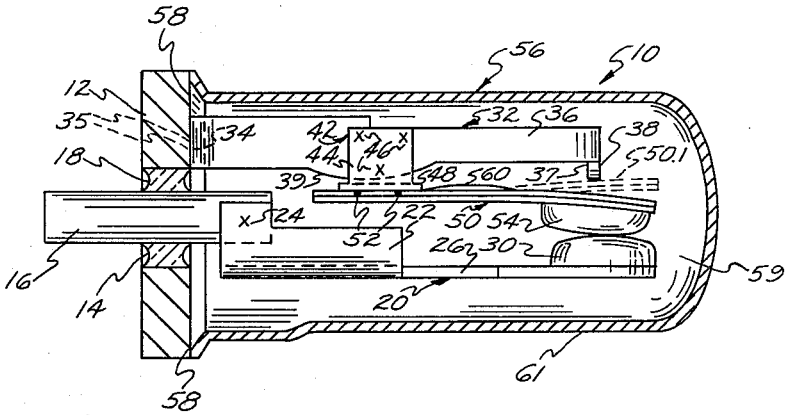

In the accompanying drawing, in which one of the various possible embodiments of the invention is illustrated:

FIG. 1 is a sectional view of a thermostatic switch useful with the invention taken along its longitudinal axis; and FIG. 2 is a sectional view along line 2—2 of FIG. 1.

Dimensions of certain of the parts as shown in the drawing may have been modified or exaggerated for the purpose of clarity of illustration.

Briefly the invention comprises the use of an atmosphere within the hermetically sealed switch having a dielectric strength which is matched with and slightly higher than the voltage level impressed on the switch. In practice the dielectric strength is reduced to one half to one fifth compared to the dielectric strength of the conventional one atmosphere pressure backfill. A preferred atmosphere consists essentially of air at a reduced pressure in the range of approximately 10 psia to 28 psia.

Referring to the drawings, numeral 10 indicates a thermostatic switch useful with this invention which is shown to include a generally disc shaped header plate or member 12 having a central aperture 14 and having a terminal post 16 secured in the plate aperture in insulated relation to the plate by means of a sealant material 18. The header plate and terminal post are preferably formed of a rigid, electrically conductive material such as steel or the like. The post is mounted in sealed, electrically insulated relation to the header plate by use of a glass sealant material 18 or other conventional electrically insulative material. As the terminal post is mounted in the header plate in the described manner by any well known technique, sealing of the terminal post in the header plate is not further described herein.

As shown, the motor protector 10 further includes a rigid electrically conductive contact arm 20 formed of steel or the like, the arm including one flange portion 22 which is welded to one side of the terminal post 16 as indicated at 24 in FIG. 2 and including an angularly disposed flange portion 26 which extends in cantilever relation from the post 16 in a plane generally parallel to the terminal post 16. A fixed contact 30 preferably formed of high electrically conductive material such as silver, is welded or otherwise secured to the distal free end of the extending portion of the contact arm as shown.

The thermostatic switch 10 further includes a heater element or member 32 having one flange portion 34 welded to the header plate 12 as indicated at 35 and having a second flange 36 extending in cantilever relation from the header plate so that an edge 37 of the extending flange faces the terminal post 16. The heater element preferably includes a stop or end portion 38 which terminates in a plane lying parallel to the axis of the terminal post 16. The header element also preferably has a rounded surface 39 formed on the edge 37 of the flange 36 as shown in FIG. 2. The heater element is formed of any one of a variety of materials of selected electrical conductivity so that the element is adapted to generate a predetermined amount of heat in response to selected flow of electrical current through the element. For example, the heater element may be formed of rigid cold rolled steel to provide the element with selected electrical heating characteristics.

In addition, the thermostatic switch 10 includes an electrically conductive, angle-shaped support 42 of cold rolled steel or the like which has one flange 44 welded to the heater element flange 36 as indicated at 46 in FIG. 2 and another flange 48 welded to an electrically conductive, resilient, thermal responsive snap acting member 50 as indicated at 52 in FIG. 1. A movable contact 54, preferably formed of the same material as the fixed contact 30, is welded or otherwise secured to the thermally responsive member oppositely of the support 42. As illustrated, the flange portion 44 of the support extends away from the thermally responsive member at substantially a right angle to the general plane of the member. The welding of the support 42 to the header 32 disposes the thermally responsive member 50 in selected heat transfer relation to the heater element and locates the member 50 extended in cantilever relation from the heater so that the movable contact 54 engages and disengages the fixed contact 30 in response to snap acting movement of the member 50. That is, the member 50 is normally located as illustrated in solid lines in FIG. 2 so that the member resiliently holds the movable contact in engagement with the fixed contact to close the circuit from the header plate 12 to the heater 32, support 42, snap acting member 50, contacts 54 and 30, and contact arm 20 to the terminal post 16.

The thermally responsive snap acting element 50 is formed from a strip-shaped blank of bimetallic material which embodies two or more layers of metal bonded together, the metals being characterized by relatively high and low coefficients of thermal expansion respectively so that the strip tends to flex in response to temperature change. The movable contact 54 is welded or otherwise secured to one end of the strip. The strip is deformed in conventional manner to provide a dish-shaped portion 60 thereby to form a snap-acting member 50 of selected thermal response characteristics. As methods for deforming such bimetallic materials to form thermally responsive snap-acting elements having precisely controlled thermal response characteristics are well known, the deformation of the strip is not further described herein.

In assembling the switch the terminal post 16 is mounted in sealed electrically insulated relation within the header plate aperture in conventional manner as shown. The heater element 32 is then welded to the header plate as indicated at 35 and the support flange 44 and flange 36 of the heater are welded at 46. The fixed contact 30 is welded or otherwise secured to the contact arm 20 and the arm flange 22 is welded to the terminal post 16 as indicated at 24 to maintain the fixed immovable contact in desired relationship.

A cup-shaped body 56 formed of steel or other rigid material is filled with a selected atmosphere and has its rim welded in electrically conductive relation to the header plate 12 as indicated at 58 to form a device chamber 59, this weld serving to seal the device chamber so that the thermostatic switch 10 is completely sealed and pressure resistant.

When switch 10 is interposed in an electric motor circuit, current flow through the heater element 32 of the thermostatic switch does not normally generate sufficient heat to cause movement of the thermally responsive member 50 so that the switch circuit remains closed. However, when abnormal current flows in the motor circuit, increased current flow through the heater element 32 generates sufficient heat to cause the snap-acting member 50 to move with a snap action to the position indicated by dotted lines 50.1 in FIG. 2 to disengage the contacts 54 and 30 and to open the described switch circuit. In this open circuit position, the snap-acting member 50 resiliently engages stop portion 38 of the heater element for limiting travel of the member away from the fixed contact and for preventing undesirable movement of the member in response to vibration and the like.

Futher details for the construction, calibration and operation of a switch as shown in the drawings may be found in U.S. Pat. No. 3,621,568 assigned to the assignee of the instant invention.

As noted above, the prior art teaching has been to employ a high dielectric gas such as nitrogen for the atmosphere within chamber 59, to improve contact life. That is, at a particular contact gap nitrogen has a relatively high breakdown voltage. However, the arc that results in a nitrogen atmosphere under normal pressures has a very high current density, that is, the arc is well defined and compact and at some minimum current density results in melting and boiling the silver surface portion of the contacts with concomittant degradation of the contacts. It is also noted above that improved cycle life is obtained with an atmosphere consisting of a mixture of helium and argon. One reason for the improved performance of the helium, argon atmosphere is the inertness of the gase, however, another reason apparently is the fact that the gas has a lower dielectric strength which results in an arc having characteristics which are less deleterious to the contact surfaces. That is, the arc produced in a lower dielectric gas is less well defined and more widely dispersed and inherently has a relatively lower current density. Thus there is less melting of the contact surface and longer life is obtained in such gas. It has been found empirically that contact life increases as dielectric strength of the gas employed decreases to a value just over the voltage impressed on the contacts.

Although most nobel, low dielectric gases are relatively expensive air can be made to perform in a manner similar to some low dielectric gases by reducing the pressure of the air. For example, improved contact life has been noted using air as the atmosphere in a switching device at a pressure in the range of approximately 10 inches to 28 inches mercury absolute. Reducing the pressure beyond 28 inches mercury absolute results in a situation in which the arc fails to become extinguished while pressures greater than 10 inches mercury absolute fail to show significant improvement.

The dielectric strength of air at various absolute pressures and for a representative air gap of 0.020 inch is shown in table A.

TABLE A

| Pressure (Absolute) Air @ Normal Humidity | Arc - Over Voltage |
|---|---|
| 1 atmosphere | 1750 VAC |
| 5 inches Hg | 1600 VAC |
| 10 inches Hg | 1475 VAC |
| 15 inches Hg | 1250 VAC |
| 20 inches Hg | 900 VAC |
| 25 inches Hg | 600 VAC |

A group of motor protector devices of a design similar to that shown in the drawings and differing from one another only in respect to the internal atmosphere were tested for twenty thousand cycles with the results shown in Table B.

TABLE B

| | Weibul - Hazard Analysis | | |
|---|---|---|---|
| Atmosphere and Pressure | Number of Failure at 20K cycles | Expected life (thousands of cycles) | 10% failure (thousands of cycles) |
| 1 Atm $N_2$ | 10 out of 12 | 14.6 | 3.8 |
| 15 inches air | 4 out of 15 | 39 | 5.1 |
| 20 inches air | 4 out of 15 | 28 | 14.2 |
| 25 inches air | 1 out of 15 | 72 | 10.5 |

Thus, knowing the impressed voltage to which the switches will be subjected, the specific pressure of the atmosphere can be selected so that the dielectric strength of the air provides maximum contact life while maintaining protection against arc-over at the impressed voltage. Normally the dielectric strength is reduced to a half to a fifth compared to the dielectric strength of the conventional one atmosphere pressure backfill, while maintaining it above the application voltage. For a typical 240 volt application the dielectric strength of the atmosphere would be chosen taking into account normal voltage variations and realizing that the gap between the contacts can vary from device to device. Typically a device could have a gap varying between 0.01 and 0.03 inch. Further, even in snap acting devices the thermal elements tend to creep slightly upon cooling and this tendency increases with age. For such a device it would be preferred to select an atmosphere having a dielectric strength of approximately 500 volts.

For many applications 24 or 25 inches mercury absolute is preferred. With regard to heat transfer charactertics, it should be noted that between 1 atmosphere and 29 inches mercury vacuum there is no significant difference in the thermal conductivity of air so the devices will react to thermal conditions in the same manner regardless of the pressure used with the 10–28 inch range.

The present invention offers several distinct advantages over conventional approaches. For one thing devices made in accordance with the invention in which air is employed are much easier and less costly to assemble than conventional backfilled devices. If nitrogen, helium or some other gas is used as the atmosphere, special equipment must be employed in assembling the devices. For example, the devices have to be placed in a so called dry box or evacuation chamber containing the appropriate atmosphere with the devices in partly assembled condition, and assembly completed within the chamber. When air is used as the atmosphere, not only is there a saving in cost of the backfill material but also no special dry box is required. All that need be provided is a device to reduce the pressure in the switch at the time of welding of cup shaped body 56 to header plate 12.

Another very significant advantage is obtained when devices are made in accordance with the invention using any reduced dielectric atmosphere, such as nitrogen or air because the contacts can be made significantly less expensively. That is, contacts used in circuit interrupting devices normally have a large percentage of silver and by means of the present invention the silver content in the contacts can be greatly reduced, by up to one half or even two thirds, while still maintaining the desired life expectancy due to the different nature of the arc produced on contact breaking as explained above.

It will be apparent to those skilled in the art that the invention can be used with switches other than the type shown in the drawing as long as the switch is hermetically sealed. For example, a multiphase switch in which several sets of contacts are employed or a switch in which the housing is of material other than metal, such as glass in which terminal 20 could extend through the header assembly.

As various changes could be in the above construction without departing from the scope of the invention, it is intended that all matter contained in the above description or shown in the accompanying drawing shall be interpreted as illustrative and not in a limiting sense.

In view of the above, it will be seen that the several objects of the invention are achieved and other advantageous results attained.

I claim:

1. Electric current interrupting apparatus adapted for use with a selected impressed voltage level comprising a hermetically sealed housing, first and second electrically conductive contacts disposed in the housing, the contacts being movable relative to one another into and out of engagement with one another, means to cause such relative movement upon the occurrence of a selected condition, electrically conductive terminal means connected to the contacts and connectable to a source of power, and an atmosphere within the housing consisting essentially of a gas having a dielectric strength of between one half and one fifth of the dielectric strength of a nitrogen backfilled atmosphere at one atmosphere of pressure.

2. Electric current interrupting apparatus adapted for use with a selected impressed voltage level comprising a hermetically sealed housing, first and second electrically conductive contacts disposed in the housing, the contacts being movable relative to one another into and out of engagement with one another, means to cause such relative movement upon the occurrence of a selected condition, electrically conductive terminal means connected to the contacts and connectable to a source of power, and an atmosphere within the housing consisting essentially of one of the group consisting of air and nitrogen at a pressure of between approximately 10 inches and 28 inches mercury absolute.

3. Electric current interrupting apparatus in accordance with claim 2 in which the atmosphere within the housing is at a pressure of between approximately 24 and 25 inches mercury absolute.

4. Electric current interrupting apparatus in accordance with claim 2 in which the means to cause the relative movement of the contacts is a thermostatic member which moves between first and second positions upon occurrence of certain temperature conditions.

5. Electric current interrupting apparatus adapted for use with a selected impressed voltage level comprising a housing having an open end, a thermostatic member mounted in the housing, the thermostatic member adapted for movement between first and second positions, movable and stationary contact means mounted within the housing, the movable contact means operatively connected to the thermostatic member so that the contacts will be in engagement when the thermostatic member is in the first position and will be out of engagement when the thermostatic member is in the second position, electrical terminals electrically connected to the respective movable and stationary contact means, and an electrically insulative header closing the open end of the housing and maintaining the terminals electrically separated from one another, and an atmosphere within the housing consisting essentially of a gas having a dielectric strength matched with the selected impressed voltage level and only slightly higher than said selected level.

6. Electric current interrupting apparatus adapted for use with a selected impressed voltage level comprising a housing having an open end, a thermostatic member mounted in the housing, the thermostatic member adapted for movement between first and second positions, movable and stationary contact means mounted within the housing, the movable contact means operatively connected to the thermosstatic member so that the contacts will be in engagement with the thermostatic member when it is in the first position and will be out of engagement when the thermostatic member is in the second position, electrical terminals electrically connected to the respective movable and stationary contact means, and an electrically insulative header closing the open end of the housing and maintaining the terminals electrically separated from one another, and an atmosphere within the housing consisting essentially of one of the group consisting of air and nitrogen at a pressure of between approximately 10 inches and 28 inches of mercury absolute.

7. Electric current interrupting apparatus in accordance with claim 6 in which the atmosphere within the housing is at a pressure of approximately between 24 and 25 inches mercury absolute.

8. A method for increasing contact life of electrical contacts used to make and break electrical current paths comprising the steps of forming a hermetic enclosure, disposing at least a pair of contacts which are movable relative to one another within the enclosure, placing an atmosphere within the enclosure consisting essentially of a selected gas at a pressure which results in a dielectric strength of the gas which is only slightly greater than the voltage level impressed on the contacts.

9. A method for increasing contact life of electrical contacts in accordance with claim 8 in which the gas is air and the pressure is less than atmospheric.

10. A method for increasing contact life of electrical contacts in accordance with claim 9 in which the pressure is between approximately 10 inches and 28 inches mercury absolute.

11. A method for increasing contact life of electrical contacts in accordance with claim 10 in which the pressure is approximately 24 and 25 inches mercury.

12. A method for increasing contact life of electrical contacts in accordance with claim 8 in which the gas is nitrogen and the pressure is less than atmospheric.

13. A method for increasing contact life of electrical contacts in accordance with claim 10 in which the pressure is between approximately 10 inches and 28 inches mercury absolute.

14. A method for increasing contact life of electrical contacts in accordance with claim 9 in which the pressure is between approximately 24 and 25 inches mercury.

* * * * *